United States Patent [19]

Bendix

[11] Patent Number: 4,561,556

[45] Date of Patent: Dec. 31, 1985

[54] HOLDER FOR PAINT BRUSHES, ROLLERS OR THE LIKE

[76] Inventor: Roger J. Bendix, P.O. Box 782, Carmichael, Calif. 95608

[21] Appl. No.: 575,911

[22] Filed: Feb. 1, 1984

[51] Int. Cl.[4] ..... B65D 25/00

[52] U.S. Cl. ..... 220/90; 206/361; 220/DIG. 6

[58] Field of Search ..... 220/90, 85 R, 1 C, DIG. 6; 248/110; 15/257 R; 206/77.1, 361

[56] References Cited

U.S. PATENT DOCUMENTS

| | | | |
|---|---|---|---|
| 1,764,763 | 6/1930 | Stans | 248/110 |
| 1,848,450 | 3/1932 | Williamson | 220/90 X |
| 2,259,927 | 10/1941 | Dunton | 220/90 X |
| 2,435,036 | 1/1948 | Ferguson | 220/90 |
| 2,469,864 | 5/1949 | Craft et al. | 220/90 X |
| 2,579,065 | 12/1951 | Channell | 220/90 X |
| 2,647,523 | 8/1953 | Vollender, Jr. | 220/85 R X |
| 2,676,730 | 4/1954 | Hedslon | 220/90 |
| 2,715,478 | 8/1955 | Andersen | 220/90 |
| 2,748,977 | 6/1956 | Sarchet | 248/110 X |
| 3,275,187 | 9/1966 | Lamoureaux | 220/90 |
| 3,329,307 | 7/1967 | Jacobson | 220/90 |
| 4,013,105 | 3/1977 | Uuskallio | 220/1 C X |

*Primary Examiner*—Allan N. Shoap
*Attorney, Agent, or Firm*—Leonard Bloom

[57] ABSTRACT

A holder for paint brushes, rollers, or the like including first and second clips each formed from a pair of legs supporting at a topmost portion thereof a coating implement support surface which is cantilevered out from and away from the container to which it is attached. Three walls of the support surface are bordered by upstanding walls, and an open end is provided for storage of the coating implement, the wall adjacent the container having a textured top surface for altering the amount of paint on the coating implement, a drain hole adjacent thereto extending through the support surface and communicating with a funnel for remigration of excess paint back into the container.

10 Claims, 2 Drawing Figures

HOLDER FOR PAINT BRUSHES, ROLLERS OR THE LIKE

BACKGROUND OF THE INVENTION

The following invention relates generally to holders for paint brushes or rollers, which holder is adapted to be supported on a peripheral lip of a paint can or the like.

Some of the most nettlesome problems associated with dispensing liquid substances such as paint from a can and applying same onto a surface includes the unwanted dripping of excess paint from the painting utensil, not having a uniform disposition of the liquid on the utensil along the entire width thereof, and not having a temporary storage site for the utensil when not in use so that the bristles on a paint brush or the nap of the roller does not become contaminated by falling to the ground or worse into the bucket of paint thereby contaminating the handle.

Various prior art attempts have been known to exist which to one degree or another provide solutions to the longstanding problems, and the following patent citations are reflective of endeavors of this type in general.

U.S. Pat. No. 1,764,763 to Stang issued June 17, 1930; U.S. Pat. No. 2,435,036 to Ferguson issued Jan. 27, 1948; U.S. Pat. No. 2,469,864 to Craft et al issued May 10, 1949; U.S. Pat. No. 2,529,257 to Kerby issued Nov. 7, 1950; U.S. Pat. No. 2,676,730 to Hedglon issued Apr. 27, 1954; and U.S. Pat. No. 2,715,478 to Andersen issued Aug. 16, 1955.

For example, Stang teaches the use of a brush holder including three upwardly extending walls adapted to support a brush. A portion of the brush extends over the support and above the can area. The holder is supported on a peripheral wall of the bucket by means of spring clips.

The remaining citations show the state of the art further and are believed to diverge from that which comprises the nexus of patentability in the instant application.

More particularly, the instant application is distinguished over the known prior art in that there has been provided an instrumentality adapted to support a coating utensil such as a paint brush or roller which supporting instrumentality is disposed such that it is cantilevered off of a side edge of a container having the coating liquid disposed therewithin whereby the support instrumentality does not occlude the opening associated with the container and therefor various diverse instruments could be used simultaneously extracting paint from the container without having the support instrumentality interfere with the operation of a second coating utensil. More specifically, the support instrumentality includes a bottom surface having a drainage hole adapted to overlie the container so that excessive liquid such as paint can migrate back into the container reservoir, three upwardly extending sidewalls defining a periphery of the support instrumentality, one of the sidewalls adjacent the drain hole and overlying a minor portion of the container including a textured surface on its upper edge so that paint contained on the painting implement may be redistributed as desired. In addition, an area on the horizontal surface adjacent the drain hole can be contoured to encourage migration of excessive paint back into the reservoir, the entire paint brush or roller support structure being cantilevered away from the mouth of the container so that access to the container by another instrument for coating can be afforded. This device lends itself for use with any size paint container.

OBJECTS AND SUMMARY OF THE INVENTION

Accordingly, this invention has as an objective the provision of an improved support for a tool such as a coating implement to be placed on a reservoir having the coating liquid therewithin which is offset from the mouth of the reservoir.

It is a further object of this invention to provide a device as characterized above including a suitable clog resistant draining instrumentality for encouraging migration of excess paint or the like back to the reservoir.

It is a further object of this invention to provide a device as characterized above in which a top edge of a sidewall of the instrumentality overlying the reservoir is provided with a textured surface so as to modify the amount of liquid material carried on the coating implement.

It is a further object of this invention to provide a device as characterized above which fastens to a vertically upstanding wall of the container in an improved manner having greater reliability and weight support capabilities.

It is a further object of this invention to provide a device as characterized above in which access to the mouth and contents of the container can be afforded with the support instrumentality in place.

It is a further object of this invention to provide a device as characterized above which is durable in construction, safe to use and is readily affordable since it lends itself to mass production techniques.

It is a still further object of this invention to provide a device as characterized above in which plural coating instruments can be used simultaneously while resting one or more of the coating implements on the support instrumentality.

These and other objects will be made manifest when considering the following detailed specification when taken in conjunction with the appended drawing figures wherein there has been provided an instrumentality adapted to receive on a surface thereof a coating utensil, a support instrumentality adapted to be supported on an upstanding wall of a reservoir containing the coating liquid therewithin, the surface of the instrumentality cantilevered away from the mouth of the reservoir so that access to the contents of the reservoir can be afforded whereby plural coating utensils can be used simultaneously by resting one coating implement on the surface of the support instrumentality while the second implement is being used, an improved non-clogging means for encouraging egress of liquid from the surface of the instrumentality back into the can, and an associated sidewall provided with a crenelated edge whereby the uniform disposition of the coating liquid upon a coating implement can be afforded prior to utilization upon a surface which is to receive the coating.

BRIEF DESCRIPTION OF THE PREFERRED EMBODIMENT

Figure 1:
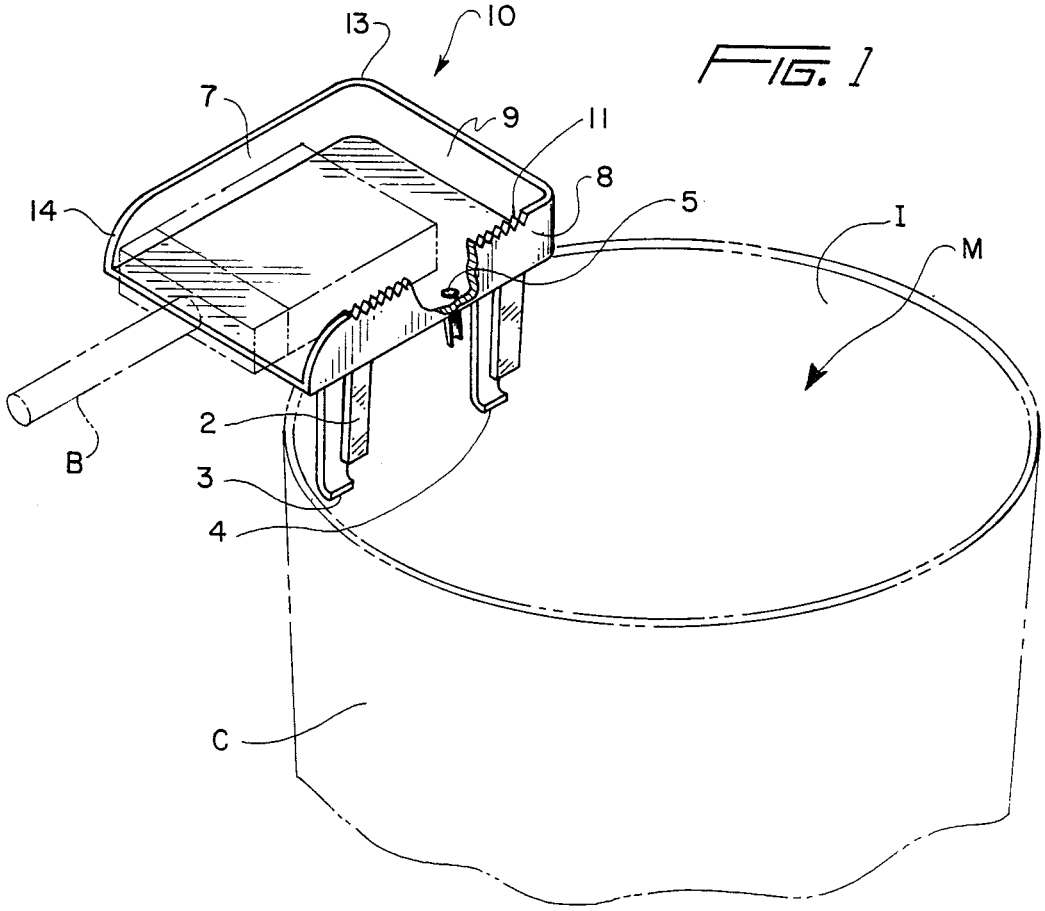
FIG. 1 is a perspective view of the apparatus according to the present invention in situ.
Figure 2:
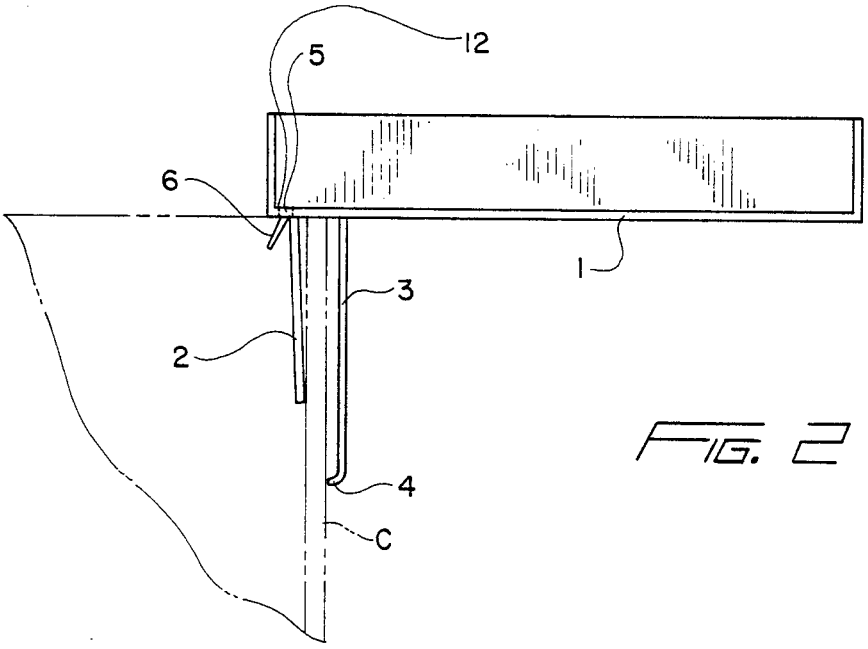
FIG. 2 is an end view thereof.

Referring to the drawings now, wherein like reference numerals refer to like parts throughout the various drawing figures, reference numeral 10 is directed to the improved paint brush/roller holder according to the present invention.

More particularly, the holder 10 is characterized as shown in the drawings by the provision of a horizontal surface 1 upon which the painting utensil such as the brush B is adapted to be supported, the horizontal surface 1 including first and second downwardly extending depending pairs of retention legs 2 and 3, each pair respectively defining clips adapted to straddle a wall of the can C. More particularly, one downwardly declinated inwardly directed (relative to the can wall) leg 2 cooperates with a second vertically extending leg 3, the leg 3 having a terminal portion 4 of arcuate hook shaped configuration adapted to engage the outer wall of the upwardly extending can C. Two pairs are preferred for stability.

As shown in the drawings, the horizontal surface 1 includes a drain hole 5 which is in overlying registry with the interior I of the container C and can include a funnel portion 6 depending from the hole to allow migration of excess paint back within the interior. The hole 5 and the associated funnel 6 is dimensioned such that the device is substantially non-clogging.

The holder 10 includes three peripheral sidewalls and an open end, the peripheral sidewalls 7 and 8 being in spaced parallel registry, the third wall 9 interconnecting the two parallel walls 7 and 8 in a perpendicular manner. The wall 8 nearest the container C includes a top edge 11 provided with a crenelated surface so that by moving the paint brush working end thereover a uniform disposition of paint on the tip of the brush can be afforded. The open wall of the holder allows the handle of the brush to extend thereover and the orientation of the device as shown in FIG. 1 is such that the major surface of the holder 1 is cantilevered out and away from the can C so that the mouth M of the container C is substantially unobstructed with the exception of the one marginal strip 12 which overlies a portion of the can that includes the drain hole 5 and the funnel 6. Thus, one coating utensil such as a brush may be supported on the holder while another instrumentality such as a roller is inserted into the bucket so that plural coating implements can be used simultaneously with one being held in storage and the opening of the container affording access to the contents. The walls 7, 8 and 9 intersect with rounded corners 13, and the terminal portion of the end walls 7 and 8 are rounded as at 14 so that no sharp edges are provided making the device extremely safe to use.

Having thus described the preferred embodiment of the invention, it should be understood that numerous structural modifications and adaptations may be resorted to without departing from the spirit of the invention as set forth hereinabove and as defined hereinbelow by the claims.

What is claimed is:

1. An improved holder for coating implements such as paint brushes, rollers, or the like comprising in combination:

a support surface cantilevered and carried on a sidewall of the container having coating liquid therewithin, said support surface carried thereon by means of at least one pair of legs engaging opposed sides of the container wall, one leg having a downwardly declinated and canted orientation relative to a vertical wall of the container adapted to engage an inner face thereof, said other leg having a vertical section and an arcuate terminal portion adapted to engage an outer face of the container, drainage means on said support surface adapted to overlie said container, and a perimeter wall circumscribing seventy-five percent of said support surface, wherein said perimeter wall is continuous, said support surface is substantially rectangular in shape, and said perimeter wall circumscribes three edges of said rectangular surface, wherein one side wall of said perimeter wall overlies a portion of the container and includes means for altering the amount of coating liquid on the implement, and wherein said altering means comprises a crenelated top edge of said wall, including two pairs of legs defining two clips, and wherein said drainage means includes a funnel depending from a bottom face of said support surface communicating with a drainage hole through said support surface.

2. The device of claim 1 wherein two of said sidewalls are in spaced parallel relationship, a third wall interconnecting said parallel walls at a right angle thereto, areas of intersection between said walls having a rounded contour, and edges of said sidewall adjacent the open portion of said support surface having tapered contour.

3. The device of claim 2 wherein said support surface is contoured to facilitate migration of excess coating liquid to said drainage means.

4. An improved holder for paint brushes, paint rollers or the like whereby support of one of a plurality of implements is afforded by said device yet the mouth of the container upon which the holder is to be disposed remains substantially unoccluded, the device comprising in combination:

first and second pairs of legs defining clips having legs adapted to be placed outside the container including vertical sections and terminal portions provided with an arcuate contour having tips adapted to abut against the container, so that said vertical legs remain parallel to and spaced from an outer wall of the container, another leg adapted to cooperate with each said vertical leg depending from a support surface and angulated towards said vertical leg so as to provide spring tension, said support surface oriented in substantially a horizontal plane and cantilevered away from an open mouth of the container, means on a top face of said support surface to support a coating implement including drainage means communicating with an interior of the container and a support wall associated with and circumscribing a portion of said support surface, wherein said support wall includes one aspect overlying a portion of the container providing it with a plurality of crenelations on a top surface thereof to modify the disposition of coating liquid on the coating implement, and a funnel depending from a bottom face of said support surface underlying said drainage means, said drainage means and said funnel dimensioned so as to allow coating liquid to pass therethrough without clogging, said funnel returning excess coating liquid back into the container.

5. The device of claim 4 wherein said upwardly extending sidewalls are provided circumscribing a portion of said support surface, said support surface being of substantially rectangular configuration and said support walls circumscribing three of the four edges associated with said support surface, an open area extending from an edge of said support surface to allow support of a paint brush or other coating implement thereon.

6. The device of claim 5 wherein said walls adjacent said open area are provided with a rounded surface so as to not provide sharp edges.

7. The device of claim 6 wherein the intersection of adjacent sidewalls are rounded to prevent inadvertent engagement with sharp corners.

8. In a holder for implements adapted to be placed on a container, support means for supporting said holder in cantilevered relation away from an open face of the container, means for altering the amount of coating liquid to be placed on a coating implement formed integral with said holder, means for facilitating drainage of excess coating liquid from said holder back to said container, said support means including first and second pairs of clips adapted to straddle inner and outer surfaces of a vertical wall of the container, said clips including a downwardly declinated leg and skewed relative to a vertical plane adapted to engage an inner wall of said container, and a vertical leg in radial registry therewith adapted to be disposed on an outer wall of said container having an arcuate terminal portion at a lower horizontal elevation than said first named leg whereby added mechanical advantages are provided by said arcuate tip and said longer leg to provide the cantilevered support, and wherein said drainage means includes a drainage hole in overlying registry with the container and funnel means for directing liquid through the drainage hole into the container formed on a bottom face of said support surface.

9. The device of claim 8 is circumscribed by perimetral wall on three sides thereof.

10. The device of claim 9 wherein one of said walls overlying said reservoir is provided with crenelations defining said means to alter the disposition of coating liquid on said coating implement.

* * * * *